US007044756B1

(12) United States Patent
Asakura et al.

(10) Patent No.: US 7,044,756 B1
(45) Date of Patent: May 16, 2006

(54) METHOD OF GROUNDING SHIELDED WIRE AND STRUCTURE FOR GROUNDING SHIELDED WIRE

(75) Inventors: Nobuyuki Asakura, Shizuoka (JP); Tadahisa Sakaguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/230,667

(22) Filed: Sep. 21, 2005

(30) Foreign Application Priority Data

Dec. 3, 2004 (JP) ..... P2004-351332

(51) Int. Cl.
*H01R 13/648* (2006.01)

(52) U.S. Cl. ..... 439/98; 439/99; 439/610

(58) Field of Classification Search ..... 439/98–99, 439/610

See application file for complete search history.

(56) References Cited

U.S. PATENT DOCUMENTS 2,768,105 A * 10/1956 Dittmore et al. ..... 156/49
5,965,847 A * 10/1999 Tanaka et al. ..... 174/84 R
6,080,018 A * 6/2000 Ferrill et al. ..... 439/610
6,116,955 A * 9/2000 Lazaro, Jr. ..... 439/610
6,485,335 B1 * 11/2002 Dewdney ..... 439/610
6,669,511 B1 * 12/2003 Yagi et al. ..... 439/610

FOREIGN PATENT DOCUMENTS

JP 10-270123 A 10/1998
JP 11-135167 A 5/1999

* cited by examiner

*Primary Examiner*—Truc Nguyen
(74) *Attorney, Agent, or Firm*—Sughrue Mion, PLLC

(57) ABSTRACT

In a method of grounding a shielded wire and a structure of grounding a shielded wire, a ring portion is formed in a ring shape by leading a braided wire to or to an opposite side of an insulating outer sheath so as to be separated in an outer circumferential direction of the insulating outer sheath. With respect to an outer circumference of the insulating outer sheath, an inner circumferential cylinder is disposed at an inner circumference side of the ring portion and an outer circumferential cylinder is disposed at an outer circumference side thereof. Further, the outer circumferential cylinder and the inner circumferential cylinder are connected each other to form a sleeve fitting. With the sleeve fitting, an attached wire is connected to the ring portion, such that grounding is performed.

4 Claims, 5 Drawing Sheets

METHOD OF GROUNDING SHIELDED WIRE AND STRUCTURE FOR GROUNDING SHIELDED WIRE

BACKGROUND OF THE INVENTION

1. Field of the Invention

The present invention relates to a method of grounding a shielded wire that grounds a braided wire in a terminal of the shielded wire, and to a structure of grounding a shielded wire.

2. Related Art

As an example of a method of grounding a shielded wire according to the related art, a method has been known in which, in a state one side of a shield terminal is placed on an insulating outer sheath and simultaneously a resin chip overlaps on one side of the shield terminal, ultrasonic vibration is applied to fuse and scatter at least the insulating outer sheath, thereby forming a shield conducting portion through which one side of the shield terminal comes into conductive contact with a braided wire is formed (for example, see Japanese Patent Publication No. JP H11-135167A).

Further, as another example of a method of grounding a shielded wire according to the related art, a method has been known in which a shield layer of a terminal of a shielded wire is folded on an outer circumference of an insulating outer sheath, the folded shield layer is caulked with a barrel of a metal shell, and simultaneously a claw portion of the barrel passes through the folded shield layer to be bit into the insulating outer sheath, thereby caulking the insulating outer sheath (for example, see Japanese Patent Publication No. JP H10-270123A).

In JP H11-135167A, an end of a lead wire is placed on the insulating outer sheath and, after the resin chip overlaps thereon, is interposed between a pair of ultrasonic horns. Then, ultrasonic vibration is applied while pressing from the upper side of the resin chip. Accordingly, the braided wire and core wire may be subjected to a large load to be damaged.

Further, in JP H10-270123A, since the claw portion of the barrel is bit into the shield layer, the shield layer may be damaged.

Generally, since the braided wire of the shielded wire is braided in a net shape to cover the entire outer circumference of a signal wire, a ground circuit needs to be reliably formed such that noise caused by external disturbance does not arrive at the signal wire.

However, as shown in FIG. 7, a method of grounding a shielded wire according to the related art peels a sheath 51 of a shielded wire 50, leads a core wire 53 from a braided wire 52, peels an end of the core wire 53, and presses and connects the core wire 53 to a terminal 54. Further, the braided wire 52 separated from the core wire 53 is pressed and connected to a terminal 55 by winding a tape or covering a contractible tube while twisting and by cutting a front end thereof to perform trimming. For this reason, work efficiency is lowered, and the braided wire 52 of the led portion is twisted in a linear shape. Accordingly, a capacity to shield the external disturbance is decreased, and thus a shield effect to the led core wire 53 may be degraded.

On the other hand, in the core wire 53 that is led and separated from the braided wire 52, a non-shield range which is not covered with the braided wire 52 by a route amount in the connector exists up to the terminal 54. Further, the braided wire 52 requires a large number of processes for additional works such as trimming to arrange the front end.

SUMMARY OF THE INVENTION

It is an object of the present invention to provide a method of grounding a shielded wire, which can enhance workability and noise shield performance, and a structure for grounding a shielded wire.

1) According to a first aspect of the present invention, there is provided a method of grounding a shielded wire having a core wire, an insulating inner sheath that covers the core wire, a braided wire that covers the insulating inner sheath, and an insulating outer sheath that is provided around the braided wire and covers the core wire, the insulating inner sheath, and the braided wire. The method of grounding a shielded wire includes peeling the braided wire to expose the braided wire and leading the braided wire to be separated in an outer circumferential direction of the insulating outer sheath to form a ring portion in a ring shape, and, in a sleeve fitting having an inner circumferential cylinder, an outer circumferential cylinder, and a connecting portion that connects ends of the inner circumferential cylinder and the outer circumferential cylinder in a longitudinal direction of the shielded wire, inserting the ring portion of the braided wire and an attached wire between the inner circumferential cylinder and the outer circumferential cylinder and pressing to one another.

According to the method of grounding a shielded wire of the first aspect of the present invention, with the sleeve fitting, the braided wire is led to be separated in the outer circumferential direction of the insulating outer sheath to form the ring portion, and the ring portion of the braided wire and the attached wire are inserted and pressed between the inner circumferential cylinder and the outer circumferential cylinder, such that the braided wire and the attached wire are connected to one another. Therefore, since a large load is not applied to the braided wire and core wire, it is possible to prevent damages from occurring and to maintain quality.

Further, since the ring portion of the braided wire that is led in the outer circumferential direction of the insulating outer sheath is formed in the ring shape, a shield capacity is not decreased, and thus it is possible to form a reliable ground circuit. In addition, since the braided wire is electrically connected to the attached wire with no additional works, such as trimming or the like, work efficiency can be enhanced. Therefore, workability and noise shield performance can be enhanced.

2) In the method of grounding a shielded wire according to the first aspect of the present invention, it is preferable that the sleeve fitting be provided with a through hole formed in the connecting portion, and the attached wire pass through the through hole and be pressed to one another with the braided wire.

According to this configuration, the core wire of the attached wire can be electrically connected to the ring portion only by passing through the through hole of the sleeve fitting. The core wire of the attached wire can be reliably connected to the ring portion, without causing the core wire of the attached wire to be disarranged.

3) According to a second aspect of the present invention, a structure for grounding a shielded wire includes a core wire that is made a conductor, an insulating inner sheath that covers the core wire, a braided wire that covers the insulating inner sheath, and a sleeve fitting that is provided around the braided wire and covers the core wire, the insulating inner wire, and the braided wire and that connects the shielded wire to an attached wire to be grounded. The sleeve fitting has an inner circumferential cylinder, an outer circumferential cylinder, and a connecting portion that connects ends of the inner circumferential cylinder and the outer circumferential cylinder in a longitudinal direction of the shielded wire. Further, the braided wire is led to be separated in an outer circumferential direction of the insulating outer sheath to form a ring portion molded in a ring shape, and the ring portion and the attached wire are inserted between the inner circumferential cylinder and the outer circumferential cylinder and pressed to one another.

According to the structure for grounding a shielded wire of the second aspect of the present invention, with the sleeve fitting, the braided wire is led to be separated in the outer circumferential direction of the insulating outer sheath to form the ring portion, and the ring portion of the braided wire and the attached wire are inserted and pressed between the inner circumferential cylinder and the outer circumferential cylinder, such that the braided wire and the attached wire are electrically connected to one another. Therefore, since a large load is not applied to the braided wire and core wire, it is possible to prevent damages from occurring and to maintain quality.

Further, since the ring portion of the braided wire that is led in the outer circumferential direction of the insulating outer sheath is formed in the ring shape, a shield capacity is not decreased, and thus it is possible to form a reliable ground circuit. Further, noise shield performance can be enhanced. In addition, since the braided wire is electrically connected to the attached wire with no additional works, such as trimming or the like, work efficiency can be enhanced.

4) In the structure for grounding a shielded wire according to the second aspect of the present invention, it is preferable that the sleeve fitting be provided with a plurality of through holes which are formed in the connecting portion and through which the attached wire passes.

According to this configuration, the core wire of the attached wire can be electrically connected to the ring portion only by passing through the through holes of the sleeve fitting. Therefore, the core wire of the attached wire can be reliably connected to the ring portion, without causing the core wire of the attached wire to be disarranged.

According to the method of grounding a shielded wire and the structure for grounding a shielded wire of the present invention, since a large load is not applied to the braided wire and core wire, workability and noise shield performance can be enhanced, and thus a high-quality shielded wire can be obtained.

DETAILED DESCRIPTION OF THE PREFERRED EMBODIMENTS

Hereinafter, a plurality of embodiments according to the present invention will be described in detail with reference to the drawings.

First Embodiment

Figure 1:
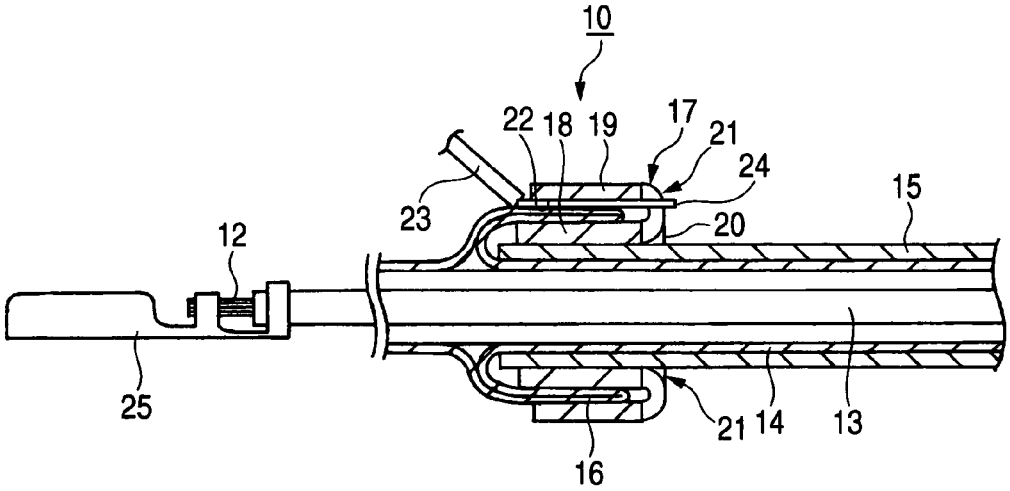
FIG. 1 is a cross-sectional view of a shielded wire which is manufactured using a first embodiment of a method of grounding a shielded wire and a structure for grounding a shielded wire according to the present invention.
Figure 2A:
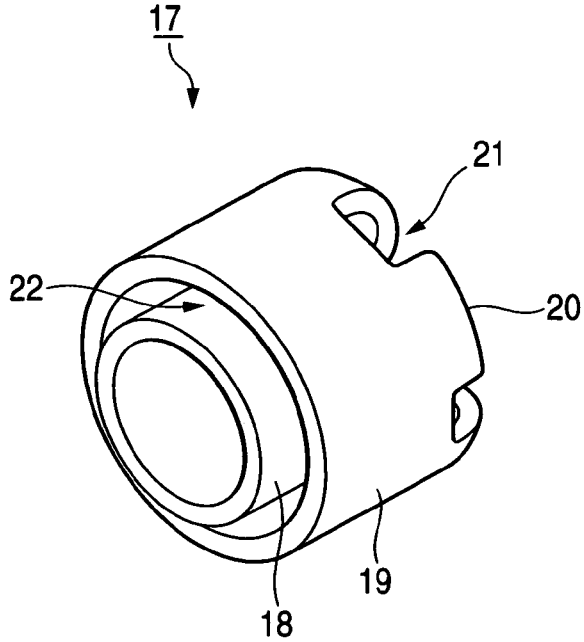
FIGS. 2A and 2B are an external perspective view and a cross-sectional view showing a sleeve fitting which is used in the method of grounding a shielded wire shown in FIG. 1, respectively.
Figure 2B:
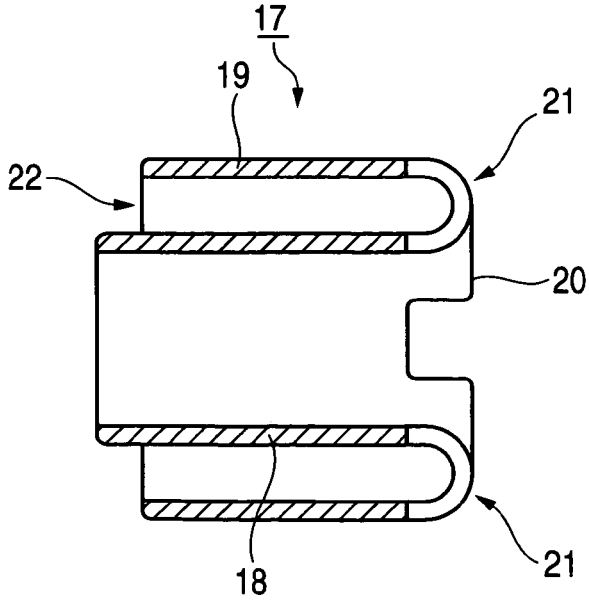
Figure 3:
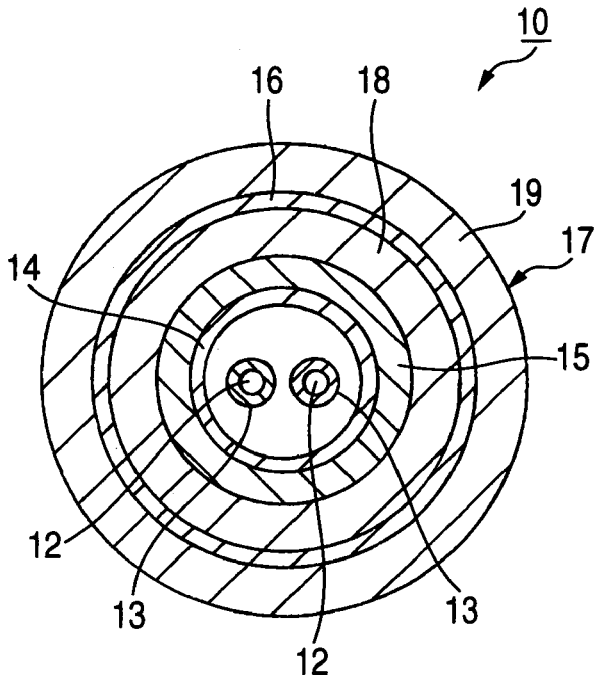
FIG. 3 is a cross-sectional view of the shielded wire shown in FIG. 1.
Figure 4:
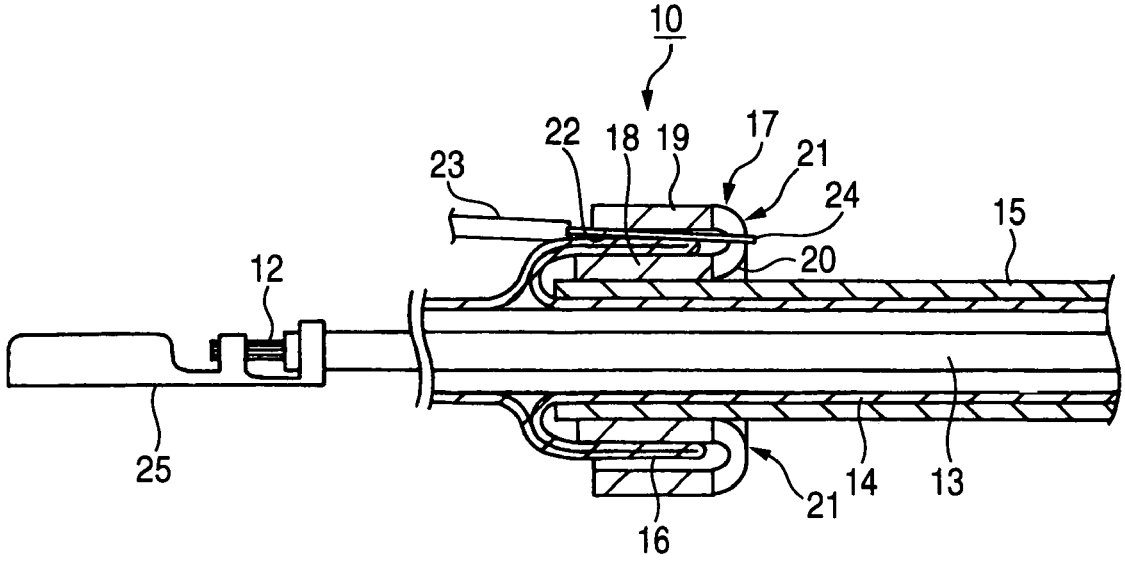
FIG. 4 is a cross-sectional view before the shielded wire shown in FIG. 1 is grounded.
Figure 5:
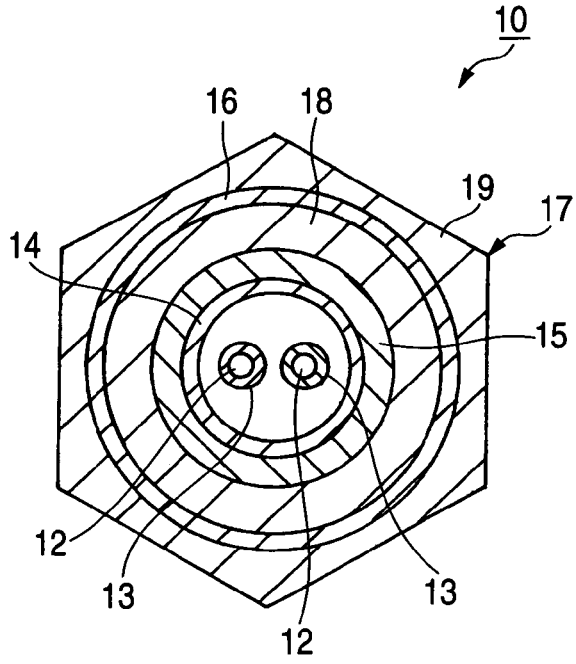
FIG. 5 is a cross-sectional view of a modification of the shielded wire shown in FIG. 1.

FIG. 1 is a cross-sectional view of a shielded wire which is manufactured using a first embodiment of a method of grounding a shielded wire and a structure for grounding a shielded wire according to the present invention. FIGS. 2A and 2B show a sleeve fitting which is used in the method of grounding a shielded wire shown in FIG. 1. FIG. 2A is an external perspective view of the sleeve fitting, and FIG. 2B is a cross-sectional view of the sleeve fitting. FIG. 3 is a cross-sectional view of the shielded wire shown in FIG. 1. FIG. 4 is a cross-sectional view before the shielded wire shown in FIG. 1 is grounded. FIG. 5 is a cross-sectional view of a modification of the shielded wire shown in FIG. 1.

As shown in FIG. 1, a shielded wire 10, which is manufactured using a method of grounding a shielded wire and a structure for grounding a shielded wire according to the present invention, has a core wire 12 made of a conductor, an insulating inner sheath 13 that covers the core wire 12, a braided wire 14 that is provided around the insulating inner sheath 13, and a resin-based insulating outer sheath 15 that is provided around the braided wire 14 and covers the core wire 12, the insulating inner sheath 13, and the braided wire 14.

A first feature of the shielded wire 10 is to lead the braided wire 14 toward the insulating outer sheath 15 to be separated in an outer circumferential direction of the insulating inner sheath 13 to form a ring portion 16 in a ring shape. Since the ring portion 16 is formed in the ring shape and is disposed on the outer circumference of the insulating outer sheath 15 in a cylindrical shape, the entire surface area covering the insulating inner sheath 13 cannot be decreased. Therefore, a high shield capacity can be maintained, and thus a ground circuit can be reliably formed.

A second feature of the shielded wire 10 is to attach the sleeve fitting 17 to the ring portion 16 of the braided wire 14 to be electrically connected thereto. The sleeve fitting 17 connects an inner circumferential cylinder 18 disposed on an inner circumference side of the ring portion 16 to an outer circumferential cylinder 19 disposed on an outer circumference side of the ring portion 16 by a connecting plate 20 in an arc shape.

As shown in FIG. 2A, the sleeve fitting 17 is made of a conductive material. The inner circumferential cylinder 18 is formed in a cylinder shape, which has an inner diameter slightly larger than an outer diameter of the insulating outer sheath 15 and a predefined outer diameter. The outer circumferential cylinder 19 is formed in a cylinder shape, which has an inner diameter larger than the outer diameter of the inner circumferential cylinder 18 and a predefined outer diameter. Then, as shown in FIG. 2B, the connecting plate 20 connects an end of the inner circumferential cylinder 18 and an end of the outer circumferential cylinder 19, such that the inner circumferential cylinder 18 and the outer circumferential cylinder 19 are integrally formed. Further, the connecting plate 20 has four through holes 21 that are formed by cutting parts of the end of the outer circumferential cylinder 19 and an end of the connecting plate 20 along an axial direction of the insulating outer sheath 15. Further, at an opposite side to the connecting plate 20, an opening 22 for inserting the ring portion 16 is formed.

In a manufacturing process, before the ring portion 16 of the braided wire 14 is led, the ring portion 16 is covered with the insulating outer sheath 15 while the opening 22 of the sleeve fitting 17 is directed to the cut side of the shielded wire 10. Then, after the ring portion 16 is formed, the sleeve fitting 17 is attached to the ring portion 16 such that the inner circumferential cylinder 18 is disposed at the inner circumference side of the ring portion 16 and the outer circumference side of the insulating outer sheath 15, and the outer circumferential cylinder 19 is disposed at the outer circumference side of the ring portion 16. At this time, a core wire 24 of an attached wire 23 is inserted from the opening 22 to pass through the through hole 21 (see FIG. 1).

As shown in FIG. 3, the shielded wire 10 is forged to have its outer diameter in a circle shape through swaging, with the sleeve fitting 17 attached thereto. Accordingly, the ring portion 16 of the braided wire 14 is electrically connected to the inner circumferential cylinder 18 of the sleeve fitting 17 with a large contact area at the inner circumference side thereof and is electrically connected to the outer circumferential cylinder 19 of the sleeve fitting 17 with a large contact area at the outer circumference side thereof, together with the core wire 24 of the attached wire 23. At this time, the inner and outer circumferential cylinders 18 and 19 of the swaged sleeve fitting 17 does not apply a large load to the insulating outer sheath 15, the braided wire 14, the insulating inner sheath 13, and the core wire 12. As such, the braided wire 14 and the core wire 12 are not damaged or broken at all.

As shown in FIG. 4, before swaging, the core wire 24 of the attached wire 23 passes through any one of the four through holes 21 that are formed in the connecting plate 20 of the sleeve fitting 17. Accordingly, when the core wire 24 passes through the through hole 21, it can be seen that the core wire 24 comes into firm contact with the ring portion 16. Simultaneously, when the remaining three through holes 21 are viewed from the outside, it can be confirmed whether or not the ring portion 16 is reliably inserted from the opening 22.

Such a shielded wire 10 is manufactured by the following processes.

First, the insulating outer sheath 15 is cut off at a predetermined position. The sleeve fitting 17 is externally inserted around the insulating outer sheath 15, and the braided wire 14 is led toward the insulating outer sheath 15 to be separated in the outer circumferential direction of the insulating outer sheath 15, such that the ring portion 16 is formed. The core wire 12 from which the insulating outer sheath 15 is removed is pressed and connected to a terminal 25.

Next, the sleeve fitting 17 is attached to the ring portion 16 so that the inner and outer circumferential cylinders 18 and 19 of the sleeve fitting 17 are disposed at the inner and outer circumference sides of the ring portion 16, respectively. At this time, the core wire 24 of the attached wire 23 is inserted from the opening 22 and then passes through one of the through holes 21.

And, swaging is performed together with the core wire 24 of the attached wire 23. Accordingly, the inner and outer circumferential cylinders 18 and 19 of the sleeve fitting 17 are electrically connected to the ring portion 16 having a large surface area with a large contact area. Then, the core wire 24 of the attached wire 23 is electrically connected to the sleeve fitting 17 that is electrically connected to the ring portion 16 with the large contact area. Further, the core wire 12 is electrically connected to the terminal 25.

Next, a modification of the shielded wire 10 will be described with reference to FIG. 5. The present modification uses hexagonal caulking. In this case, the shielded wire 10 is caulked to have its outer diameter in a hexagonal shape through hexagonal caulking, with the sleeve fitting 17 attached thereto. Accordingly, the ring portion 16 of the braided wire 14 is electrically connected to the inner circumferential cylinder 18 with a large contact area at the inner circumference side thereof and is electrically connected to the outer circumferential cylinder 19 with a large contact area at the outer circumference side thereof, together with the core wire 24 of the attached wire 23. At this time, the hexagonally caulked sleeve fitting 17 does not apply a large load to the insulating outer sheath 15, the braided wire 14, the insulating inner sheath 13, and the core wire 12, such that the braided wire 14 and the core wire 12 are not damaged at all. Further, the outer circumferential cylinder 19 is formed to have its outer circumference in a hexagonal shape, thereby exerting a function of preventing rotation when being inserted into a connector (not shown), for example.

As described above, according to the method of grounding a shielded wire and a structure for grounding a shielded wire of the present embodiment, with respect to the ring portion 16 that is led to be separated in the outer circumferential direction of the insulating outer sheath 15 formed in a ring shape, the inner circumferential cylinder 18 is disposed at the inner circumference side thereof and simultaneously the outer circumferential cylinder 19 is disposed at the outer circumference side thereof, such that the sleeve fitting 17 electrically connects the ring portion 16 to the core wire 24 of the attached wire 23. In such a manner, a large load is not applied to the braided wire 14 and the core wire 12, and thus it is possible to prevent damages from occurring and to maintain quality.

Further, since the ring portion 16 of the braided wire 14 which is led in the outer circumferential direction of the insulating outer sheath 15 is formed in the ring shape, a shield capacity is not decreased, such that a reliable ground circuit can be formed. In addition, since the braided wire 14 is electrically connected to the attached wire with no additional works, such as trimming or the like, work efficiency can be enhanced. Therefore, workability and noise shield performance can be enhanced.

Further, according to the method of grounding a shielded wire and a structure for grounding a shielded wire of the present embodiment, since a non-shield range is small with respect to the core wire 12, it is possible to obtain a shield effect in a wide range. Further, since a uniform outer diameter can be obtained by swaging or hexagonal caulking, satisfactory shield characteristics against external disturbance can be realized so as not to be affected by noise. In addition, since the core wire 24 of the attached wire 23 can be electrically connected to the ring portion 16 only by passing through the through hole 21 of the sleeve fitting 17, the core wire 24 of the attached wire 24 can be reliably connected to the ring portion 16, without causing the core wire 24 of the attached wire 23 to be disarranged.

Second Embodiment

Next, a second embodiment of a method of grounding a shielded wire and a structure for grounding a shielded wire according to the present invention will be described with reference to FIG. 6. Moreover, in FIG. 6, the same parts as those in the shielded wire 10 described above are represented by the same or corresponding reference numerals, and thus the descriptions thereof will be simplified or omitted.

Figure 6:
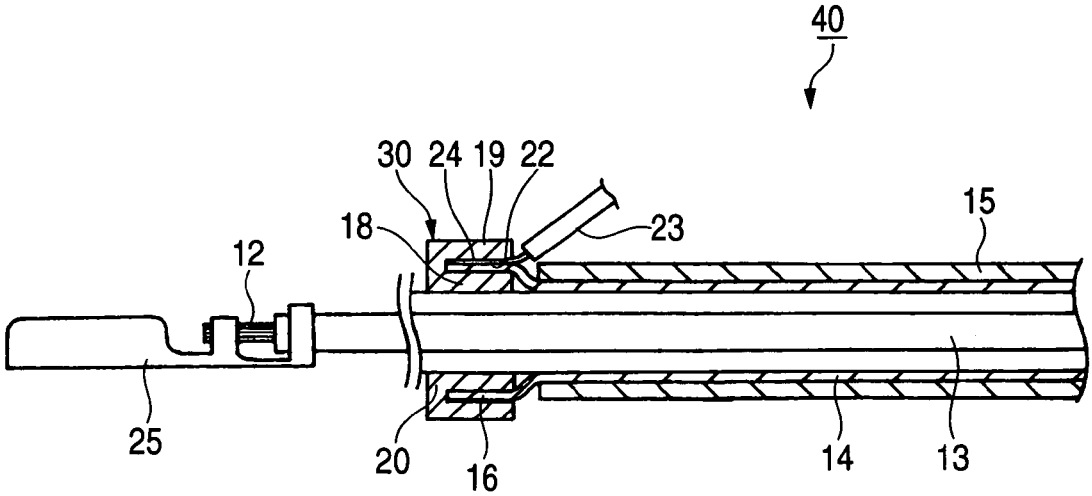
FIG. 6 is a cross-sectional view of a shielded wire which is manufactured using a second embodiment of a method of grounding a shielded wire and a structure for grounding a shielded wire according to the present invention.
Figure 7:
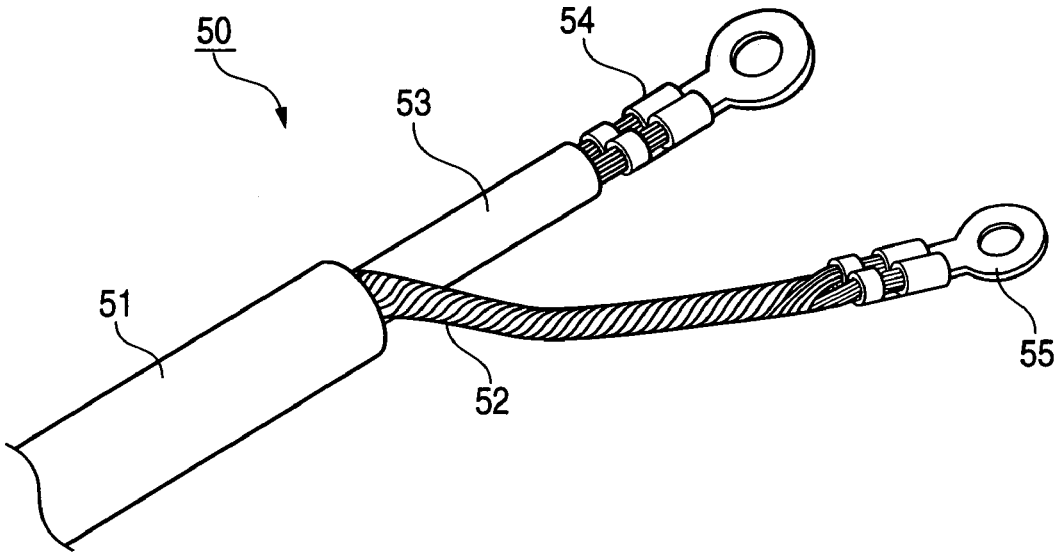
FIG. 7 is a diagram showing an appearance of a shielded wire according to the related art.

FIG. 6 is a cross-sectional view of a shielded wire manufactured using the second embodiment of the method of grounding a shielded wire and a structure for grounding a shielded wire according to the present invention.

As shown in FIG. 6, a sleeve fitting 30 that is used in the method of grounding a shielded wire according to the second embodiment of the present invention is attached in an opposite direction to the first embodiment. For this reason, a ring portion 16 of a braided wire 14 is led to an opposite side to an insulating outer sheath 15 so as to be separated in an outer circumferential direction of the insulating outer sheath 15.

Further, in the method of grounding a shielded wire 40 using the sleeve fitting 30, the sleeve fitting 30 is attached to fit to the ring portion 16 that is led to the opposite side to the insulating outer sheath 15 so as to be separated in the outer circumferential direction of the insulating outer sheath 15. Then, a core wire 24 of an attached wire 23 is inserted from an opening 22 and is formed to have a uniform outer diameter by swaging or hexagonal caulking. In such a manner, the core wire 24 of the attached wire 23 is electrically connected to the ring portion 16 through the sleeve fitting 30.

Further, the present invention is not limited to the above-mentioned embodiments, but various modifications or alternatives can be appropriately made. For example, the thickness of the inner circumferential cylinder or the outer circumferential cylinder in the sleeve fitting can be properly selected according to the diameter of the braided wire or the braiding type.

What is claimed is:

1. A method of grounding a shielded wire having a core wire, an insulating inner sheath that covers the core wire, a braided wire that covers the insulating inner sheath, and an insulating outer sheath that is provided around the braided wire and covers the core wire, the insulating inner sheath, and the braided wire, the method of grounding a shielded wire comprising the steps of:

peeling the braided wire to expose the braided wire and leading the braided wire to be separated in an outer circumferential direction of the insulating outer sheath so as to form a ring portion molded in a ring shape; and providing a sleeve fitting having an inner circumferential cylinder, an outer circumferential cylinder, and a connecting portion that connects ends of the inner circumferential cylinder and the outer circumferential cylinder in a longitudinal direction of the shielded wire, inserting the ring portion of the braided wire and an attached wire between the inner circumferential cylinder and the outer circumferential cylinder and pressing to one another.

2. The method of grounding a shielded wire according to claim 1, wherein the sleeve fitting is provided with a through hole formed in the connecting portion, and the attached wire passes through the through hole and is pressed to one another with the braided wire.

3. A structure for grounding a shielded wire, comprising:

a core wire that is made a conductor;

an insulating inner sheath that covers the core wire;

a braided wire that covers the insulating inner sheath; and a sleeve fitting that is provided around the braided wire and covers the core wire, the insulating inner wire, and the braided wire and that connects the shielded wire to an attached wire to be grounded, wherein the sleeve fitting has an inner circumferential cylinder, an outer circumferential cylinder, and a connecting portion that connects ends of the inner circumferential cylinder and the outer circumferential cylinder in a longitudinal direction of the shielded wire, and the braided wire is led to be separated in an outer circumferential direction of the insulating outer sheath to form a ring portion molded in a ring shape, and the ring portion and the attached wire are inserted between the inner circumferential cylinder and the outer circumferential cylinder and pressed to one another.

4. The structure for grounding a shielded wire according to claim 3, wherein the sleeve fitting is provided with a plurality of through holes which are formed in the connecting portion and through which the attached wire passes.

* * * * *